US006202218B1

(12) United States Patent
Chen

(10) Patent No.: US 6,202,218 B1
(45) Date of Patent: Mar. 20, 2001

(54) HAT DEVICE

(76) Inventor: Tsao-Hui Chen, 58, Ma Yu West St., Taichung (TW)

( * ) Notice: Subject to any disclaimer, the term of this patent is extended or adjusted under 35 U.S.C. 154(b) by 0 days.

(21) Appl. No.: 09/406,399

(22) Filed: Sep. 27, 1999

(51) Int. Cl.[7] ..... A42B 1/00
(52) U.S. Cl. ..... 2/195.1; 2/175.1
(58) Field of Search ..... 2/195.1, 10, 12, 2/15, 425, 171, 181.4, 181.6, 209.12, 175.1; 359/516, 880; 296/97.1, 97.4, 97.8, 97.11

(56) References Cited

U.S. PATENT DOCUMENTS 4,776,628 * 10/1988 Plolito ..... 296/97.6
4,793,006 * 12/1988 Dawson ..... 2/191
5,075,898 * 12/1991 Bedient ..... 2/10
5,197,150 * 3/1993 Bedient ..... 2/195
5,621,915 * 4/1997 Schneider et al. ..... 2/10
5,689,830 * 11/1997 Pflum ..... 2/195.1
5,749,618 * 5/1998 Jones ..... 296/978
5,839,125 * 11/1998 Chen ..... 2/195.1
5,964,494 * 10/1999 Miller ..... 296/97.1

* cited by examiner

*Primary Examiner*—John J. Calvert
*Assistant Examiner*—Katherine Moran

(57) ABSTRACT

A hat device has a main body, and a fixed peak disposed on a front portion of the main body. An extensible visor has two lateral elastic plates, two grooves, and a blocking flange. The fixed peak has a slot and a periphery flange. The extensible visor is inserted in the slot of the fixed peak.

1 Claim, 6 Drawing Sheets

HAT DEVICE

BACKGROUND OF THE INVENTION

The present invention relates to a hat device. More particularly, the present invention relates to a hat device which has an extensible visor.

Referring to FIG. 7, a conventional hat device has a main body 30, a fixed peak 31 disposed on a front portion of the main body 30, and an extensible visor 40 engaged with the fixed peak 31. An insertion block 41 is disposed on the extensible visor 40. The insertion block 41 has two opposite lateral teeth 42. A pair of L-shaped racks 32 are disposed on the fixed peak 31. Each L-shaped rack 32 has a front block 34 and a plurality of serrations 33. Each lateral teeth 42 engages with the respective serrations 33. The extensible visor 40 can be extended. Each insertion block 41 moves along the respective serrations 33 of the L-shaped rack 32. However, the frictional engagement between the serrations 33 and the lateral teeth 42 is very rigid without any elasticity so that it is very difficult to retract the extensible visor 40 or extend the extensible visor 40 while the user does not exert force along the direction of the L-shaped rack 32. This structure is disclosed by U.S. Pat. No. 5,839,125.

SUMMARY OF THE INVENTION

An object of the present invention is to provide a hat which has an extensible visor to be extended.

In accordance with a first preferred embodiment of the present invention, a hat device comprises a main body, a fixed peak disposed on a front portion of the main body, and an extensible visor engaging with the fixed peak. A blocking flange is disposed on an edge of the extensible visor. The extensible visor has two lateral elastic plates and two grooves. The fixed peak has a slot and a periphery flange. The extensible visor is inserted in the slot of the fixed peak.

In accordance with a second preferred embodiment of the present invention, a hat device comprises a main body, a fixed peak disposed on a front portion of the main body, and an extensible visor engaging with the fixed peak. A blocking flange is disposed on an edge of the extensible visor. The fixed peak has a slot, a periphery flange, and two rows of corrugated serrations. The extensible visor has two lateral elastic plates, two grooves, and two rows of lateral teeth engaging with the corrugated serrations. The extensible visor is inserted in the slot of the fixed peak. When the extensible visor is retracted to the utmost, the blocking flange of the extensible visor and the periphery flange of the fixed peak block each other.

DETAILED DESCRIPTION OF THE INVENTION

Figure 1:
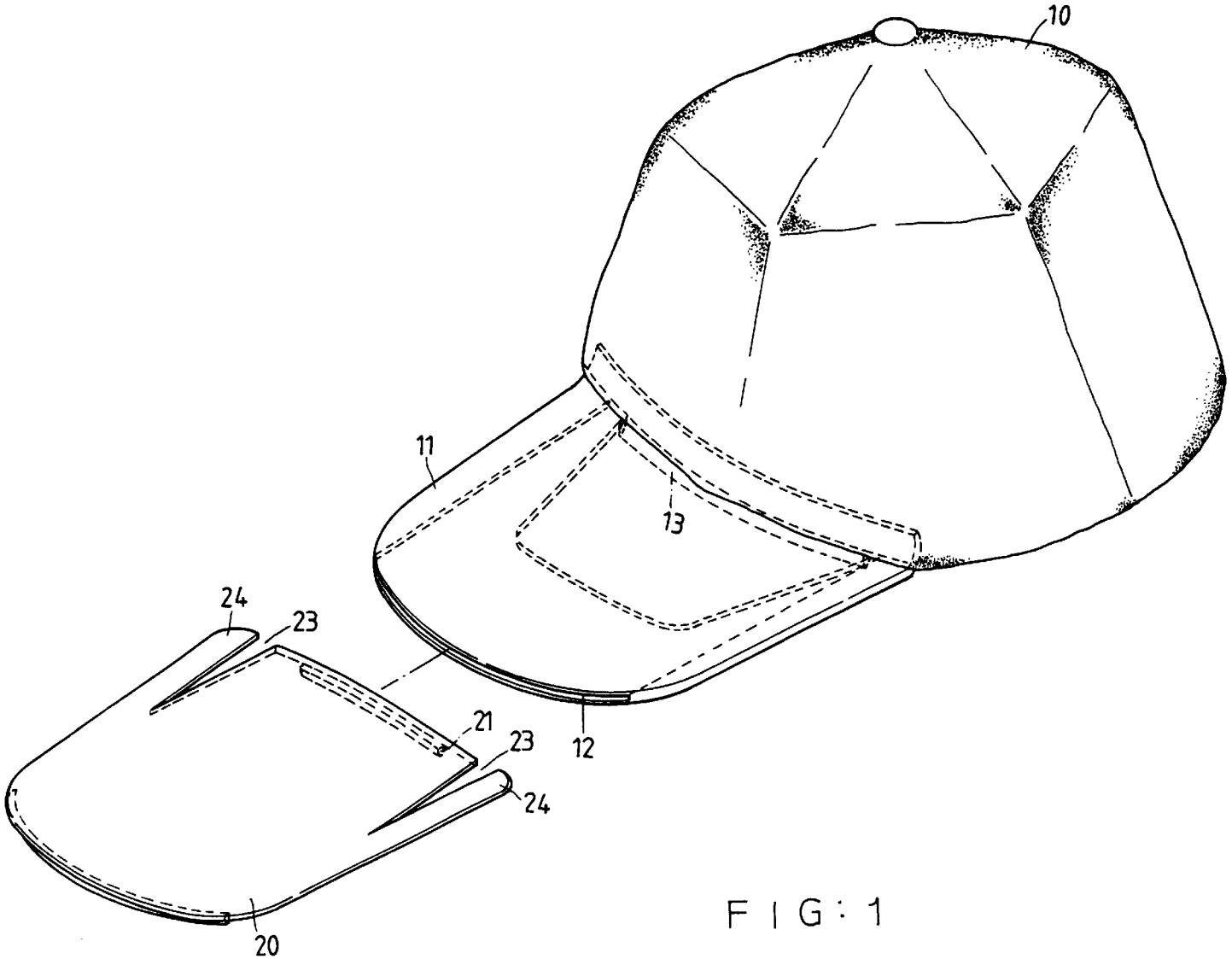
FIG. 1 is a perspective exploded view of a hat device of a first preferred embodiment in accordance with the present invention.
Figure 3:
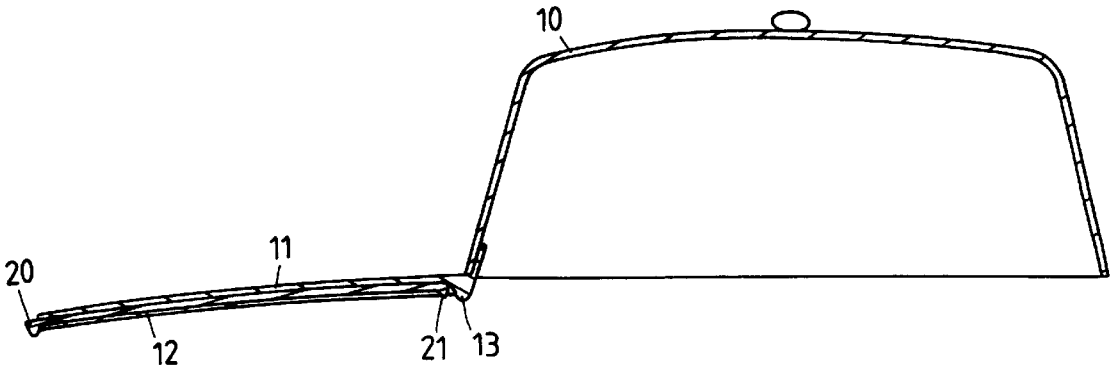
FIG. 3 is a sectional schematic view illustrating an extensible visor of a first preferred embodiment is retracted.
Figure 4:
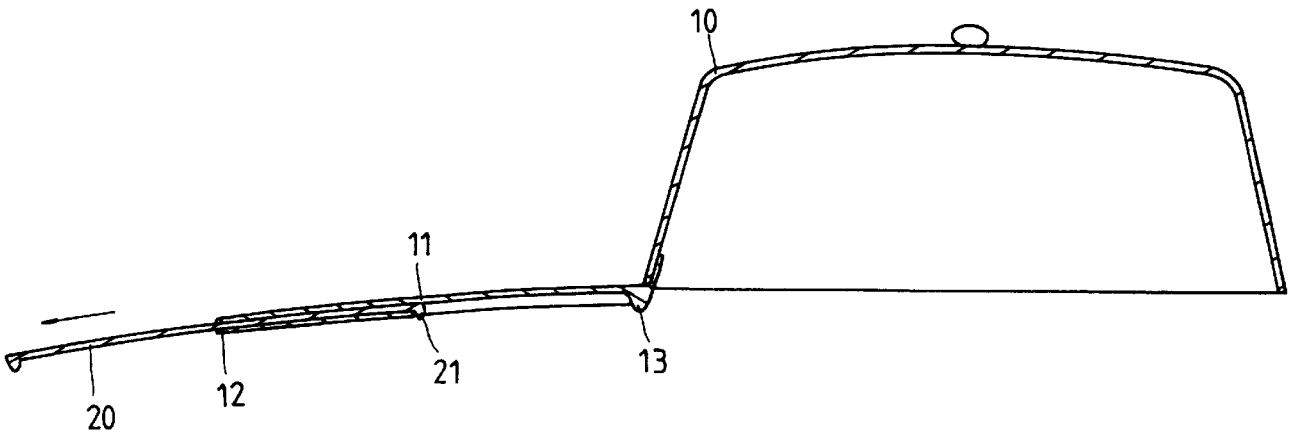
FIG. 4 is a sectional schematic view illustrating an extensible visor of a first preferred embodiment is extended.

Referring to FIG. 1, FIG. 3, and FIG. 4, a first hat device comprises a main body 10, a fixed peak 11 disposed on a front portion of the main body 10, and an extensible visor 20 engaging with the fixed peak 11. A blocking flange 21 is disposed on an edge of the extensible visor 20.

The extensible visor 20 has two lateral elastic plates 24 and two grooves 23.

The fixed peak 11 has a slot 12 and a periphery flange 13.

The extensible visor 20 is inserted in the slot 12 of the fixed peak 11.

When the extensible visor 20 is retracted to the utmost, the blocking flange 21 of the extensible visor 20 and the periphery flange 13 of the fixed peak 11 blocks each other.

Figure 2:
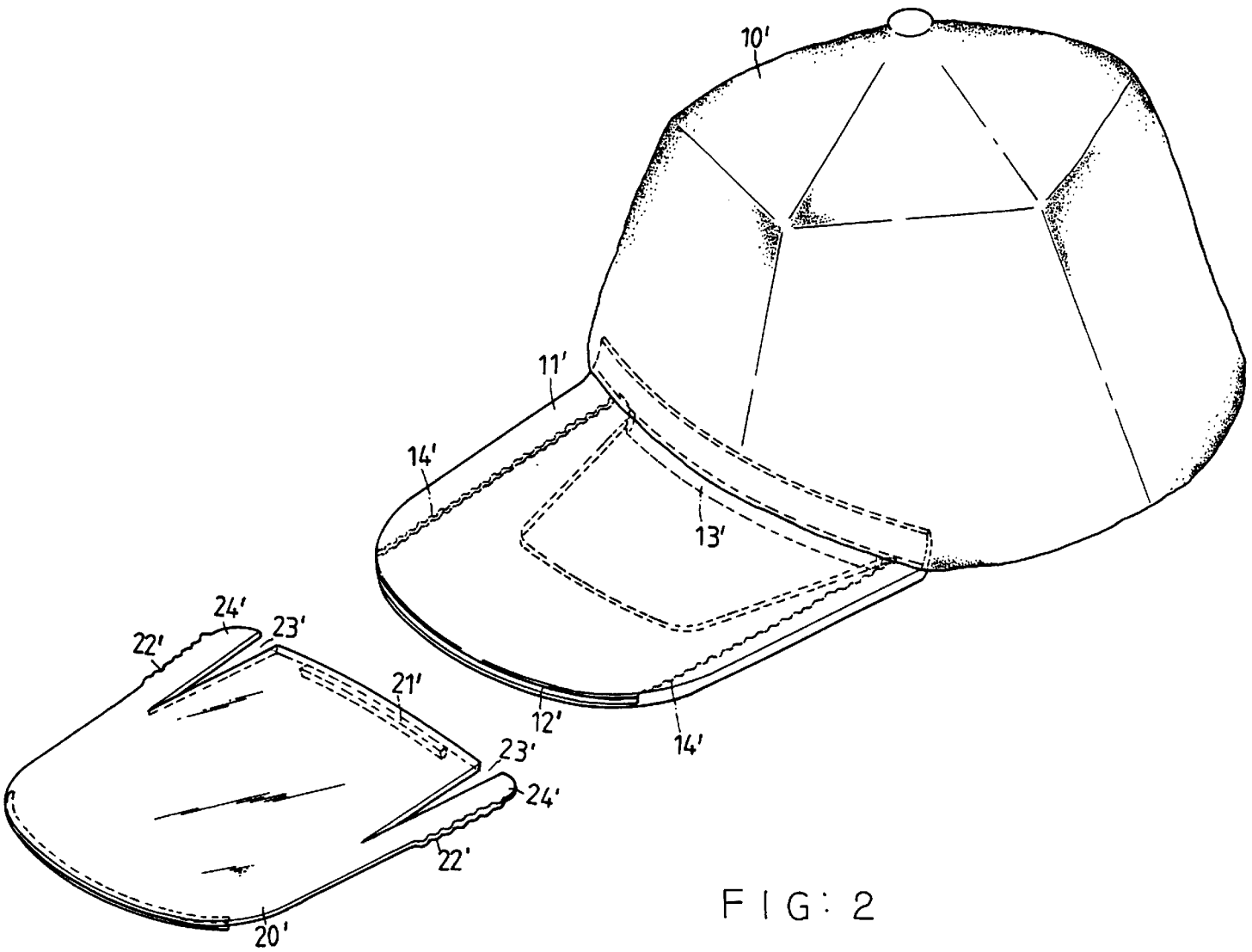
FIG. 2 is a perspective exploded view of a hat device of a second preferred embodiment in accordance with the present invention.
Figure 5:
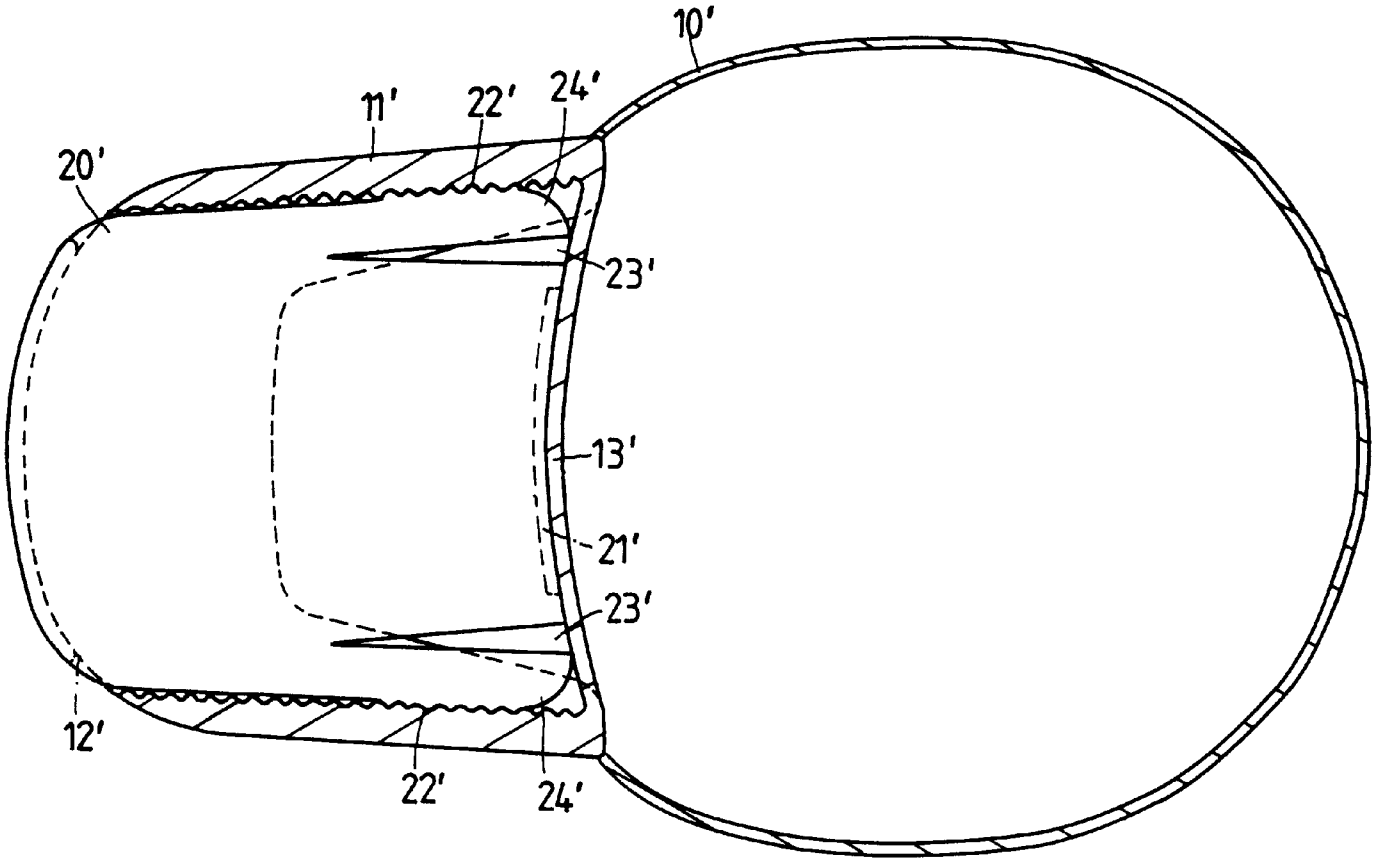
FIG. 5 is a sectional schematic view illustrating an extensible visor of a second preferred embodiment is retracted.
Figure 6:
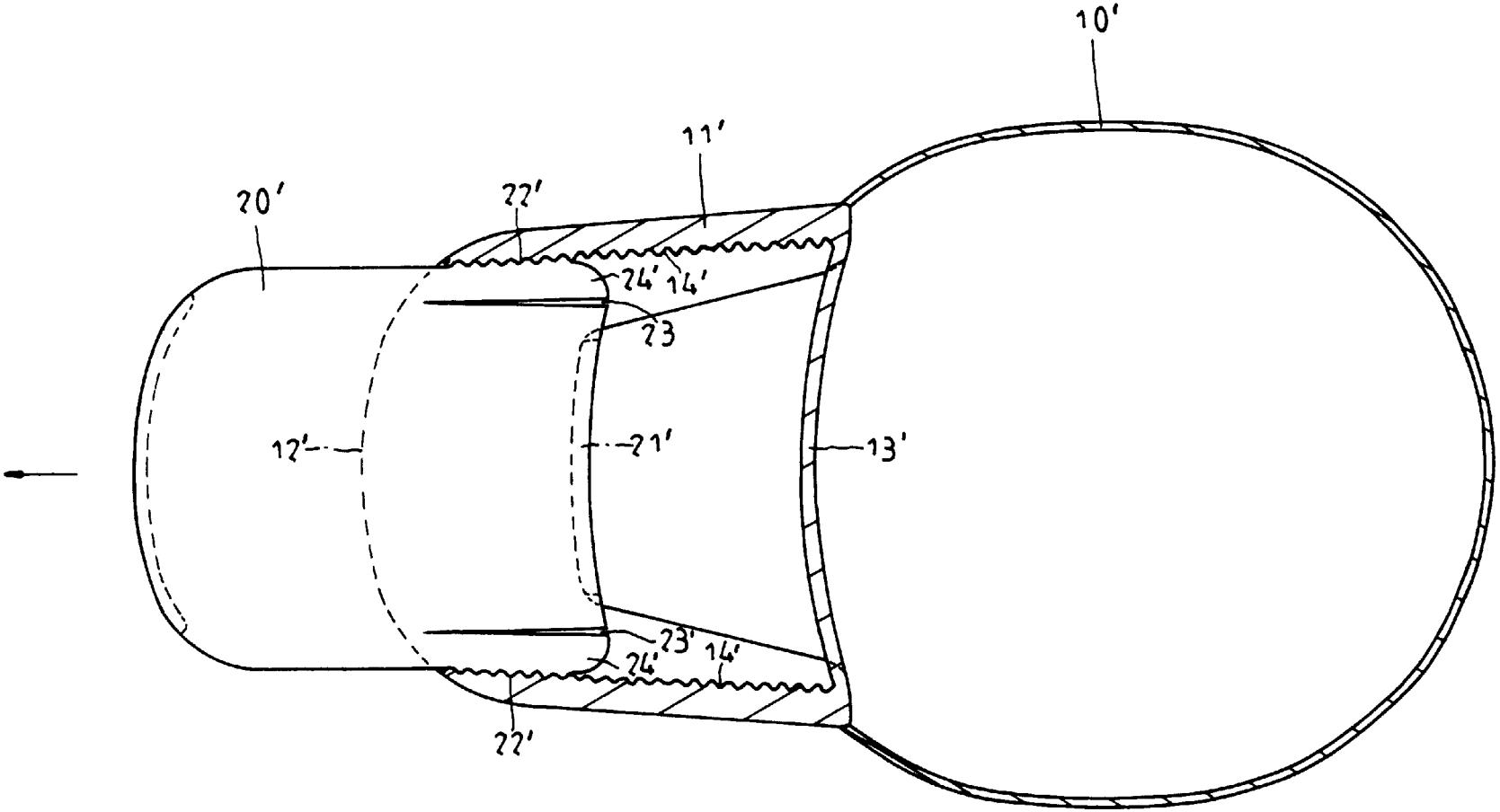
FIG. 6 is a sectional schematic view illustrating an extensible visor of a second preferred embodiment is extended.
Figure 7:
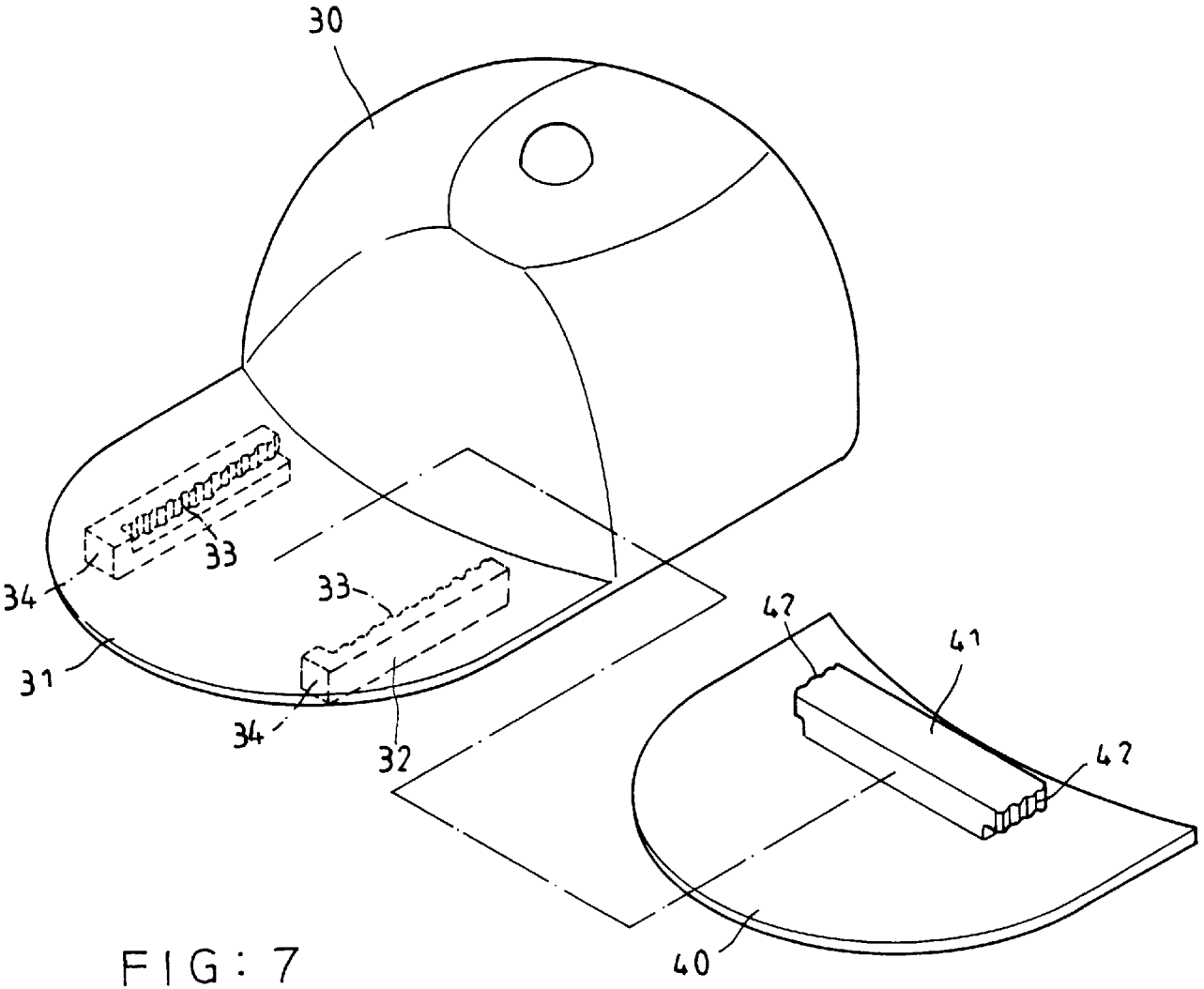
FIG: 7 PRIOR ART
FIG. 7 is a perspective exploded view of a hat device of the prior art.

Referring to FIG. 2, FIG. 5, and FIG. 6, a second hat device comprises a main body 10', a fixed peak 11' disposed on a front portion of the main body 10', and an extensible visor 20' engaging with the fixed peak 11'. A blocking flange 21' is disposed on an edge of the extensible visor 20'.

The fixed peak 11' has a slot 12', a periphery flange 13', and two rows of corrugated serrations 14'.

The extensible visor 20' has two lateral elastic plates 24', two grooves 23', and two rows of lateral teeth 22' engaging with the corrugated serrations 14'.

The extensible visor 20' is inserted in the slot 12' of the fixed peak 11'.

When the extensible visor 20' is retracted to the utmost, the blocking flange 21' of the extensible visor 20' and the periphery flange 13' of the fixed peak 11' block each other.

The present invention is not limited to the above embodiments but various modification thereof may be made. Furthermore, various changes in form and detail may be made without departing from the scope of the present invention.

I claim:

1. A hat device comprises:

a main body, a fixed peak disposed on a front portion of the main body, an extensible visor engaging with the fixed peak, a blocking flange disposed on an edge of the extensible visor, the extensible visor having two rows of flexible lateral teeth, two lateral elastic plates and two grooves, the fixed peak having two rows of corrugated serrations, a slot and a periphery flange, and the extensible visor inserted in the slot of the fixed peak.

* * * * *